US011306472B2

(12) United States Patent
Lin

(10) Patent No.: US 11,306,472 B2
(45) Date of Patent: Apr. 19, 2022

(54) SEWAGE DISCHARGE DEVICE

(71) Applicant: FUJIAN AIDI ELECTRIC CO., LTD., Longyan (CN)

(72) Inventor: Xi Zhen Lin, Xiamen (CN)

(73) Assignee: FUJIAN AIDI ELECTRIC CO., LTD., Longyan (CN)

( * ) Notice: Subject to any disclaimer, the term of this patent is extended or adjusted under 35 U.S.C. 154(b) by 0 days.

(21) Appl. No.: 17/006,919

(22) Filed: Aug. 31, 2020

(65) Prior Publication Data

US 2021/0388595 A1 Dec. 16, 2021

(30) Foreign Application Priority Data

Jun. 16, 2020 (CN) ..... 202010547573.1

(51) Int. Cl.
*E03F 1/00* (2006.01)
*F04D 9/04* (2006.01)
*E03F 5/22* (2006.01)

(52) U.S. Cl.
CPC ..... *E03F 1/006* (2013.01); *F04D 9/041* (2013.01); *E03F 5/22* (2013.01)

(58) Field of Classification Search
CPC .. E03F 1/006; E03F 1/008; E03F 5/22; F04D 9/041
USPC ..... 4/431
See application file for complete search history.

(56) References Cited

U.S. PATENT DOCUMENTS 4,550,453 A * 11/1985 Norman ..... E03D 5/00 134/166 R
4,722,556 A * 2/1988 Todd ..... F16L 25/0036 285/12
4,854,827 A * 8/1989 McKiernan ..... E03D 5/00 417/313
5,035,583 A * 7/1991 Vaught ..... F04D 9/041 417/200
6,352,088 B1 * 3/2002 Stegall ..... B60R 15/00 137/899
6,991,192 B2 * 1/2006 Phillips ..... B60R 15/04 241/46.01
7,108,010 B2 * 9/2006 Trentadue ..... F16K 15/03 137/527.8
8,826,939 B2 * 9/2014 Damaske ..... F16L 15/08 137/899
9,617,993 B2 * 4/2017 Mehta ..... F04C 13/001

* cited by examiner

*Primary Examiner* — Huyen D Le
(74) *Attorney, Agent, or Firm* — Bayramoglu Law Offices LLC

(57) ABSTRACT

A sewage discharge device detachably and hermetically connected to a sewage tank includes a drain pipe and a main box body. A drain control valve and a self-priming drain pump are provided inside the main box body. One end of the drain control valve is detachably and hermetically connected to the drain pipe. The other end of the drain control valve is detachably and hermetically connected to the self-priming drain pump. The self-priming drain pump is provided with a drain nozzle and a cleaning coupling. The drain nozzle is detachably and hermetically connected to a sewage pipe. The drain nozzle and the cleaning coupling protrude outside the main box body. The sewage discharge device of the present invention prevents users from contacting fecal matter and wastewater. Manual cleaning of the drain pipe is also eliminated, which is convenient to use.

9 Claims, 12 Drawing Sheets

SEWAGE DISCHARGE DEVICE

CROSS REFERENCE TO THE RELATED APPLICATIONS

This application is based upon and claims priority to Chinese Patent Application No. 202010547573.1, filed on Jun. 16, 2020, the entire contents of which are incorporated herein by reference.

TECHNICAL FIELD

The present invention belongs to the technical field of sewage discharge, and more particularly, relates to a sewage discharge device.

BACKGROUND

Vehicles with living spaces, such as high-speed trains, yachts, mobile toilets and recreational vehicles, are continually being improved through advances in science and technology. Users produce a substantial amount of domestic sewage in these mobile vehicles with living spaces. Consequently, sewage tanks are typically installed in these mobile activity spaces to collect domestic sewage, thereby realizing the treatment of sewage and wastewater.

A recreational vehicle, for example, also known as "wheeled house", is regarded as a combination of a "house" and a "vehicle". The recreational vehicle is essentially a mobile vehicle with basic facilities necessary for home use. Traditional recreational vehicles are equipped with specially designed sewage tanks for collecting domestic sewage. When the recreational vehicle arrives at a recreational vehicle park (RV park), the sewage outlet of the sewage tank of the recreational vehicle is connected to a drain pipe, whereby sewage can be discharged to a sewage treatment station in the RV park or directly discharged to the edge of a suburban field. After the sewage is discharged, it is necessary to manually disconnect the drain pipe from the sewage outlet of the tank of the recreational vehicle, and then clean the drain pipe. In such a process, users can directly contact sewage, which for many reasons is unacceptable.

It is, therefore, highly desirable to provide an improved sewage discharge device to solve the above-mentioned shortcomings of the prior art.

SUMMARY

An objective of the present invention is to provide a sewage discharge device that is convenient to use.

To achieve the above-mentioned objective, the present invention adopts the following technical solutions.

A sewage discharge device detachably and hermetically connected to a sewage tank includes a drain pipe and a main box body. A drain control valve and a self-priming drain pump are provided inside the main box body. One end of the drain control valve is detachably and hermetically connected to the drain pipe. The other end of the drain control valve is detachably and hermetically connected to the self-priming drain pump. The self-priming drain pump is provided with a drain nozzle and a cleaning coupling. The drain nozzle is detachably and hermetically connected to a sewage pipe. The drain nozzle and the cleaning coupling protrude outside the main box body.

A master switch for controlling the operation of the self-priming drain pump is provided on a side wall of the main box body. The master switch, the drain nozzle and the cleaning coupling are located on the same side of the main box body.

The sewage pipe is provided with a drain connector. One end of the drain connector is a grip, and the other end of the drain connector is a pipe connection end. A control switch for controlling the operation of the self-priming drain pump is provided on the grip.

The control switch is connected to the self-priming drain pump in a wired manner or a wireless manner.

The pipe connection end is provided with a multilayer threaded section, and the diameter of the threaded section successively increases from bottom to top.

The self-priming drain pump includes a motor, an impeller, a pump body, a crushing blade and a pump connector. A rotating shaft of the motor drives the impeller to rotate. The drain nozzle is arranged on the pump body. The crushing blade is rotatably arranged at one end of the pump body, and the other end of the pump body is detachably fixed to the motor. One end of the pump connector is detachably fixed to one end of the pump body, and the other end of the pump connector is hermetically connected to the other end of the drain control valve. A cleaning water inlet is arranged in the middle of the pump connector and protrudes from the middle of the pump connector. The cleaning coupling is hermetically connected to the outside of the cleaning water inlet. A one-way valve is provided inside the cleaning coupling. The one-way valve is provided between the cleaning water inlet and the cleaning coupling.

A motor bracket is detachably fixed under the motor, and the end of the motor bracket is fixed to an anti-vibration pad.

The motor is provided with an anti jamming manual rotary knob, and the anti-jamming manual rotary knob is arranged outside the main box body and protrudes from the main box body.

The other end of the pump connector and the other end of the drain control valve are connected through a clamping claw and a clamping column snap-fitted with each other to form a quick-disconnect fitting. The drain pipe and the sewage tank are connected through a clamping claw and a clamping column snap-fitted with each other to form a quick-disconnect fitting. One end of the drain control valve is connected to the drain pipe through a clamping claw and a clamping column snap-fitted with each other to form a quick-disconnect fitting.

A lifting handle is provided on the main box body.

In the above technical solutions, according to the structural design of the drain pipe and the main box body, the drain control valve and the self-priming drain pump are provided inside the main box body, so that sewage in the drain pipe is controlled to enter the self-priming drain pump by the drain control valve and then discharged through the drain nozzle and sewage pipe of the self-priming drain pump after being treated by the self-priming drain pump. When the domestic sewage has been discharged, the cleaning coupling arranged on the self-priming drain pump is configured to introduce cleaning water to clean the drain pipe and the self-priming drain pump. Then the cleaning water is discharged through the drain nozzle of the self-priming drain pump and the sewage pipe. In this way, it is convenient to use the sewage discharge device without needing to manually clean the drain pipe, which prevents users from contacting the sewage. Moreover, since the drain control valve and the self-priming drain pump are both provided inside the main box body, it is convenient for users to carry the sewage discharge device.

DESCRIPTION OF THE REFERENCE NUMERALS

Figure 1:
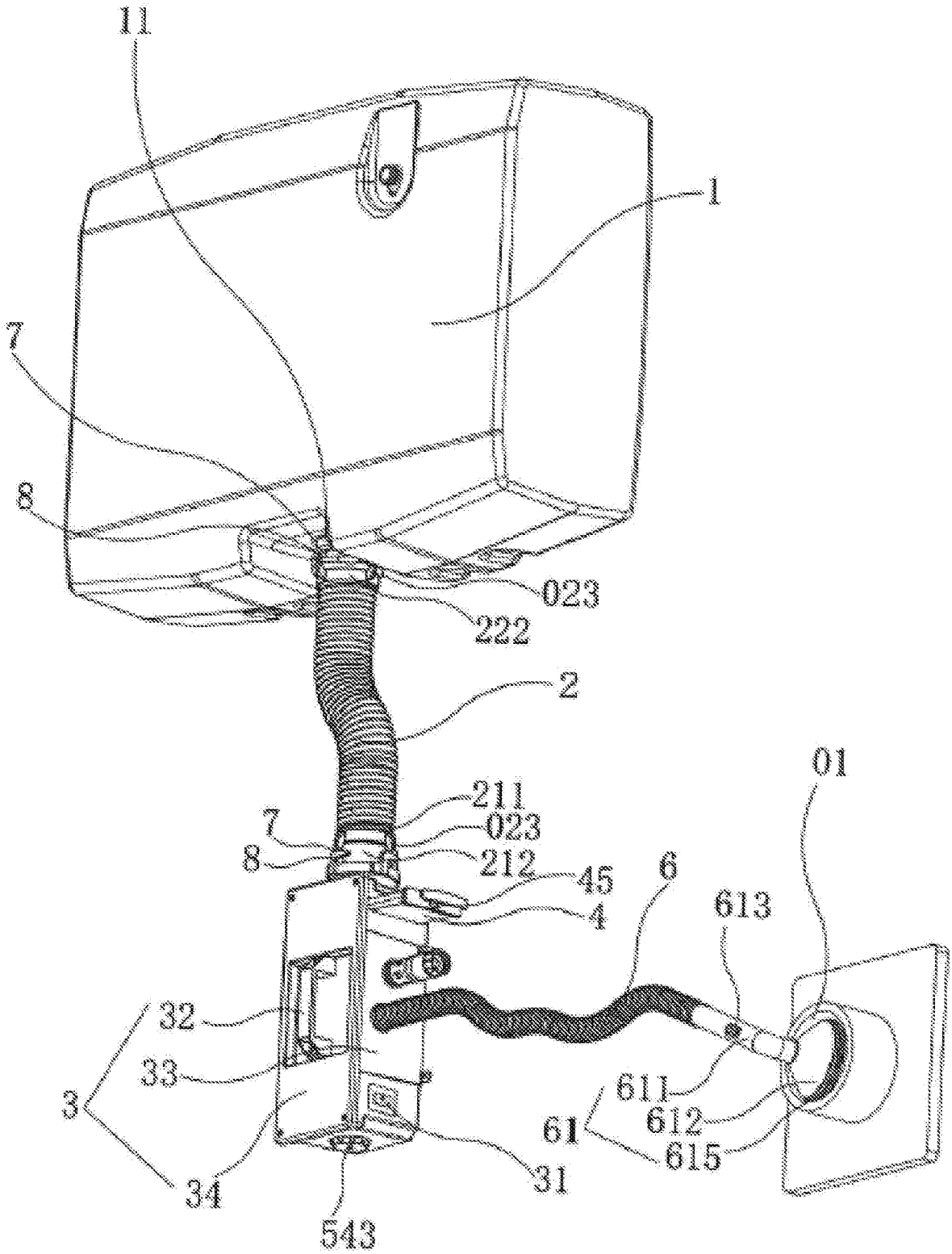
FIG. 1 is a perspective view of the present invention in use.
Figure 2:
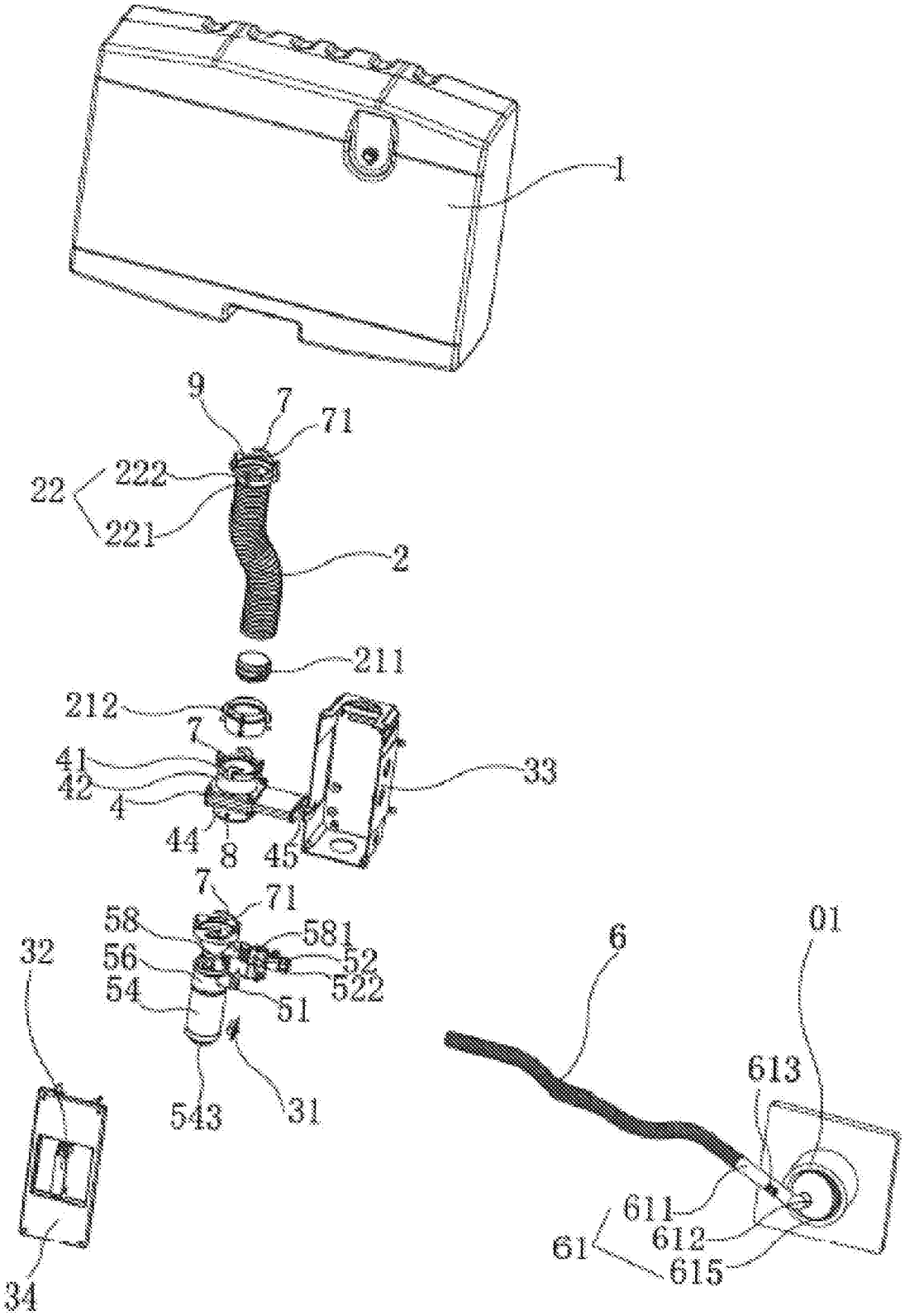
FIG. 2 is a first exploded view of FIG. 1.
Figure 3:
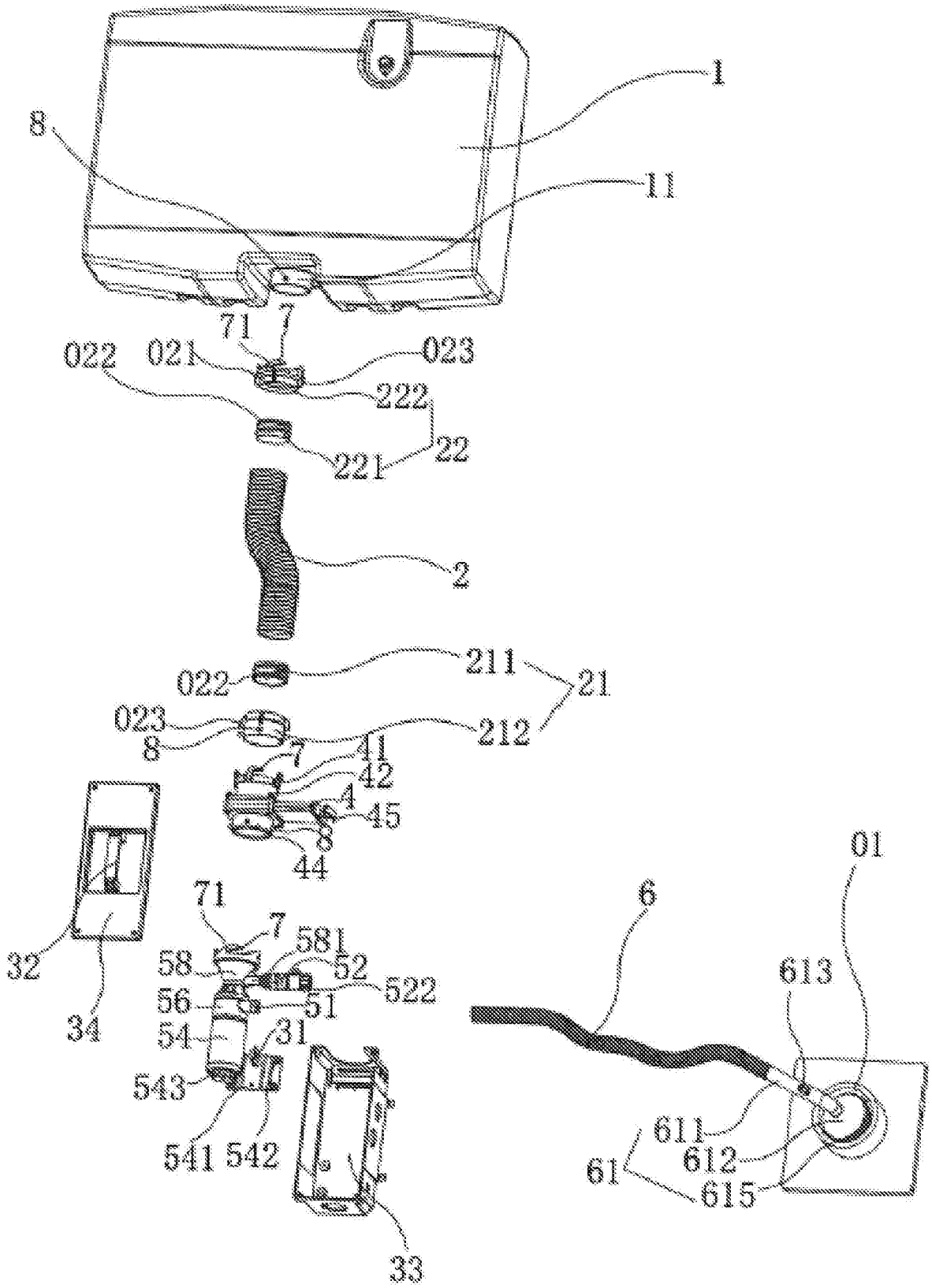
FIG. 3 is a second exploded view of FIG. 1.
Figure 4:
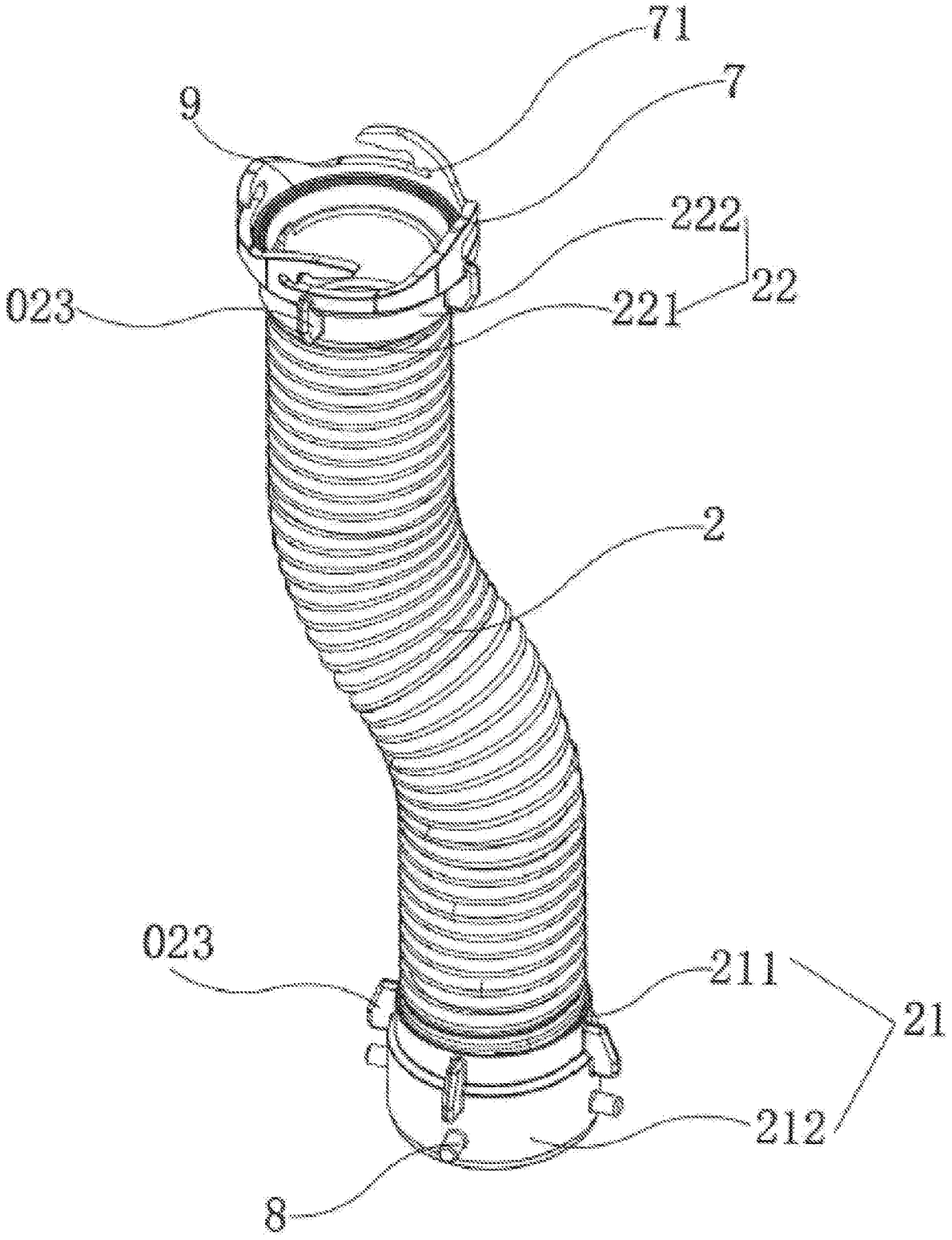
FIG. 4 is a perspective view of the drain pipe of the present invention.
Figure 5:
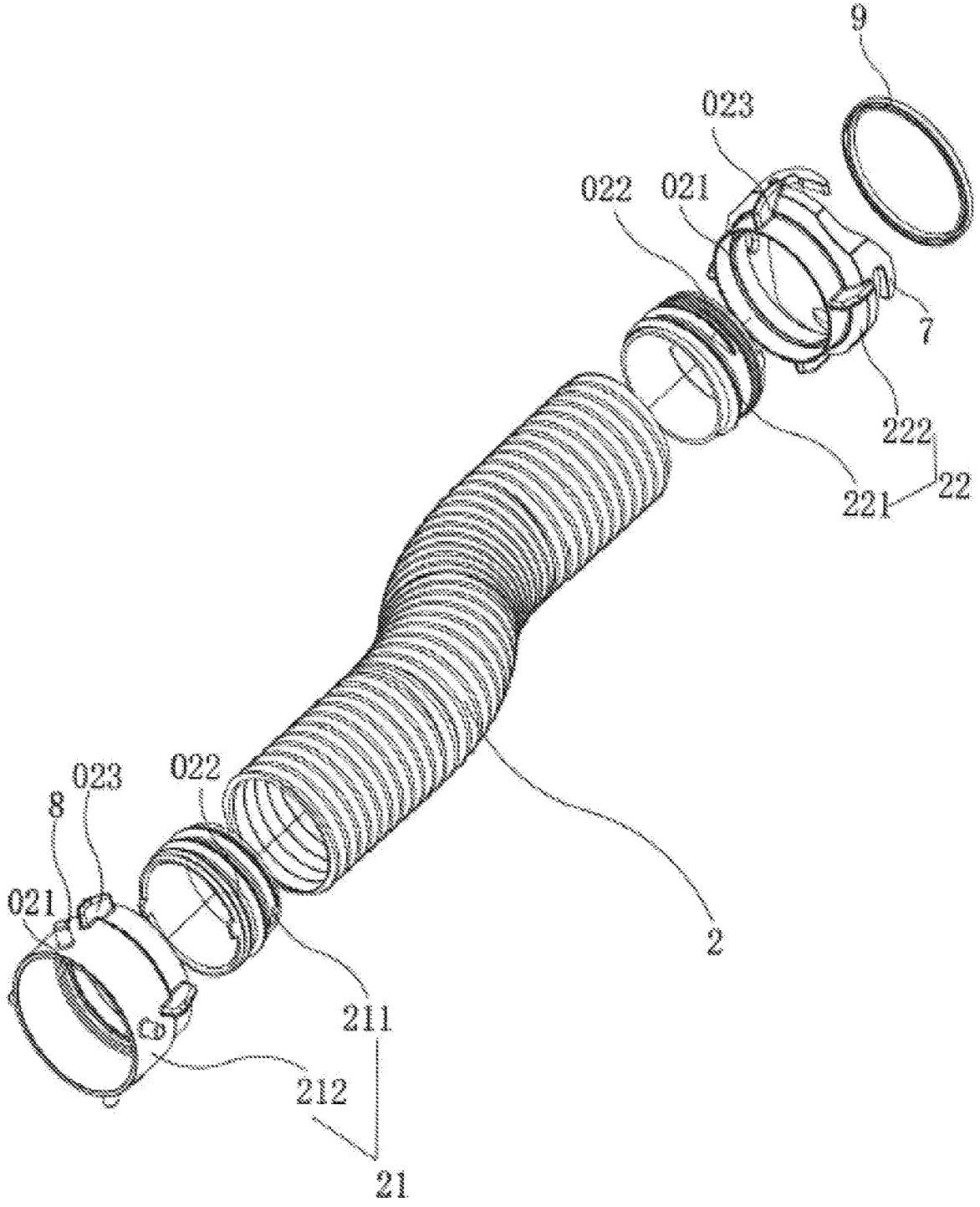
FIG. 5 is an exploded view of FIG. 4.
Figure 6:
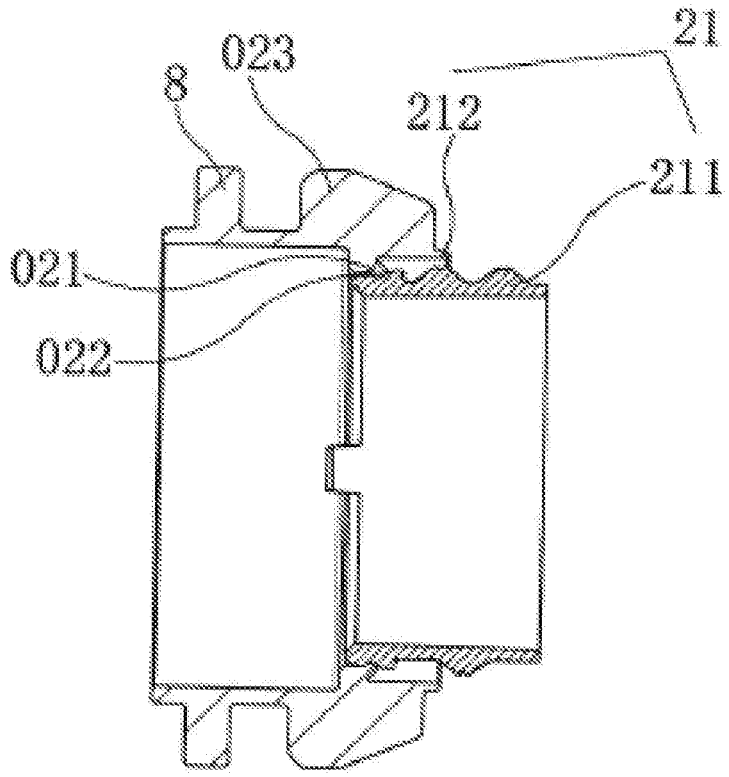
FIG. 6 is a cross-sectional view of a first coupling assembly of the drain pipe of the present invention.
Figure 7:
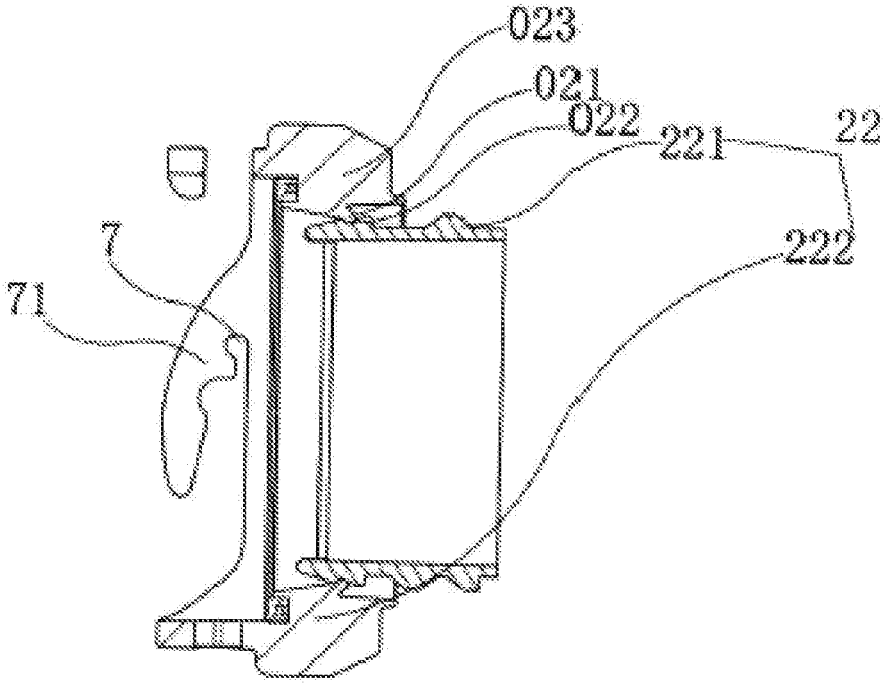
FIG. 7 is a cross-sectional view of a second coupling assembly of the drain pipe of the present invention.
Figure 8:
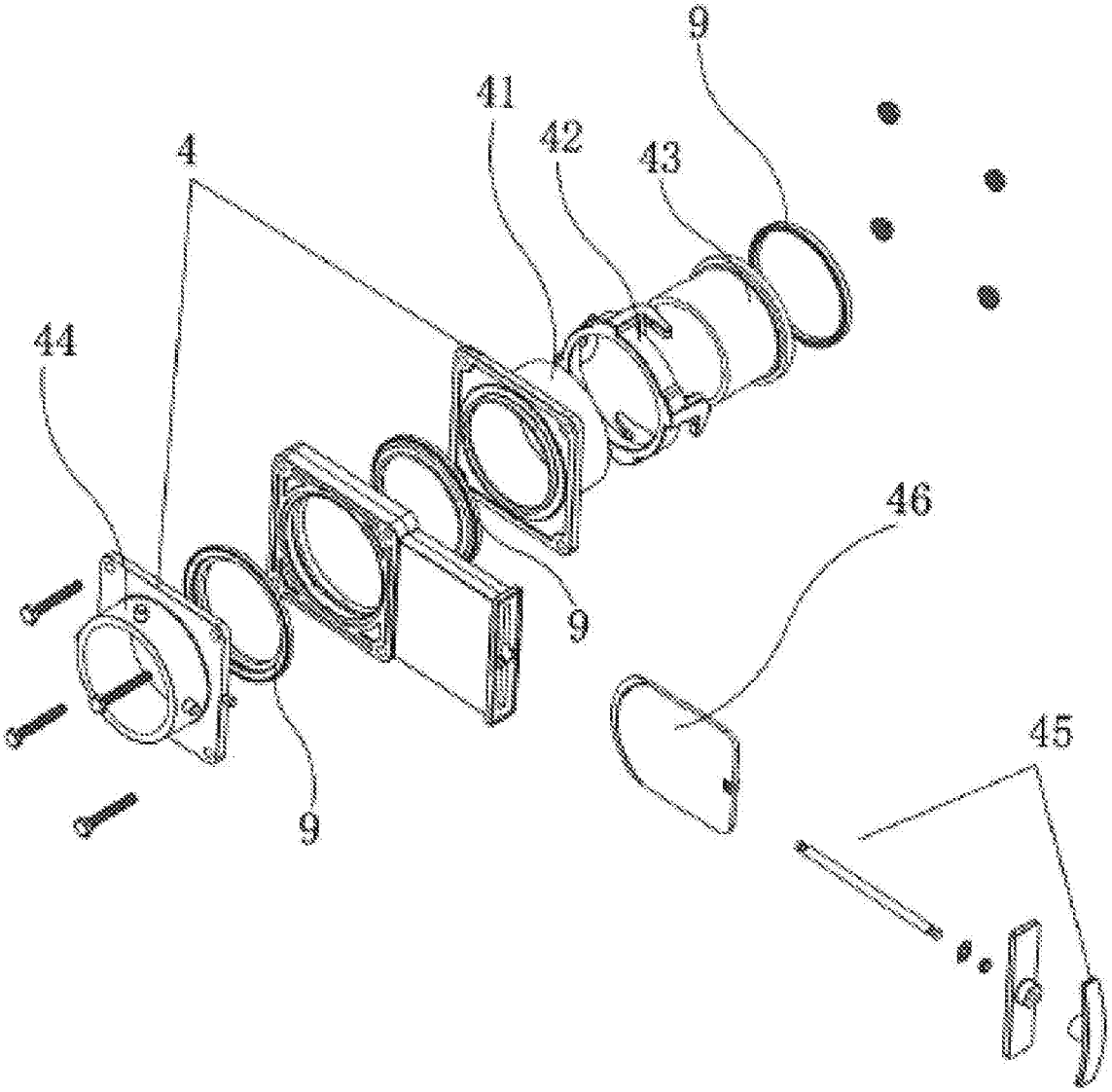
FIG. 8 is an exploded view of the drain control valve of the present invention.
Figure 9:
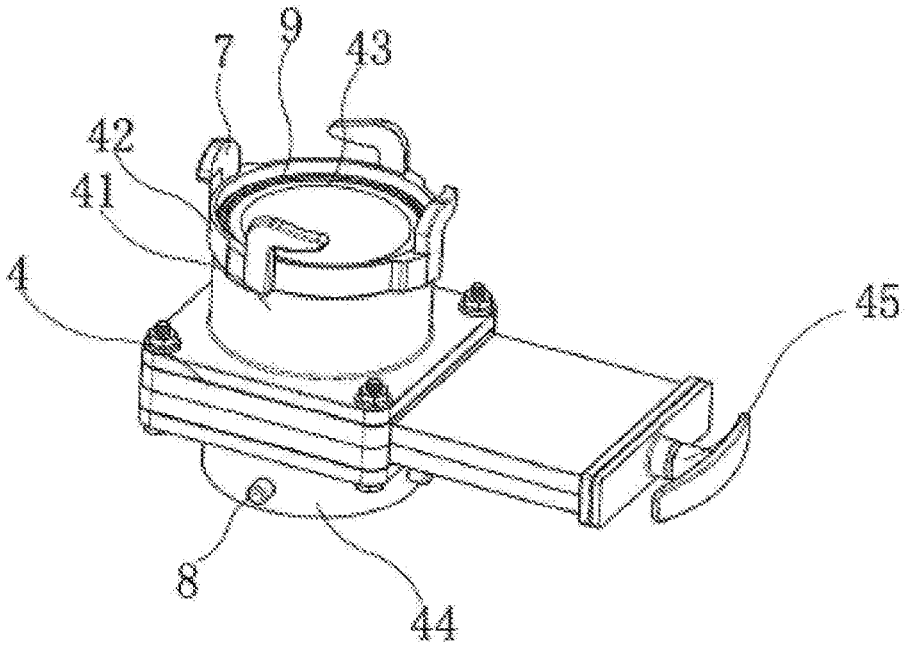
FIG. 9 is a partial perspective view of the present invention.
Figure 9:
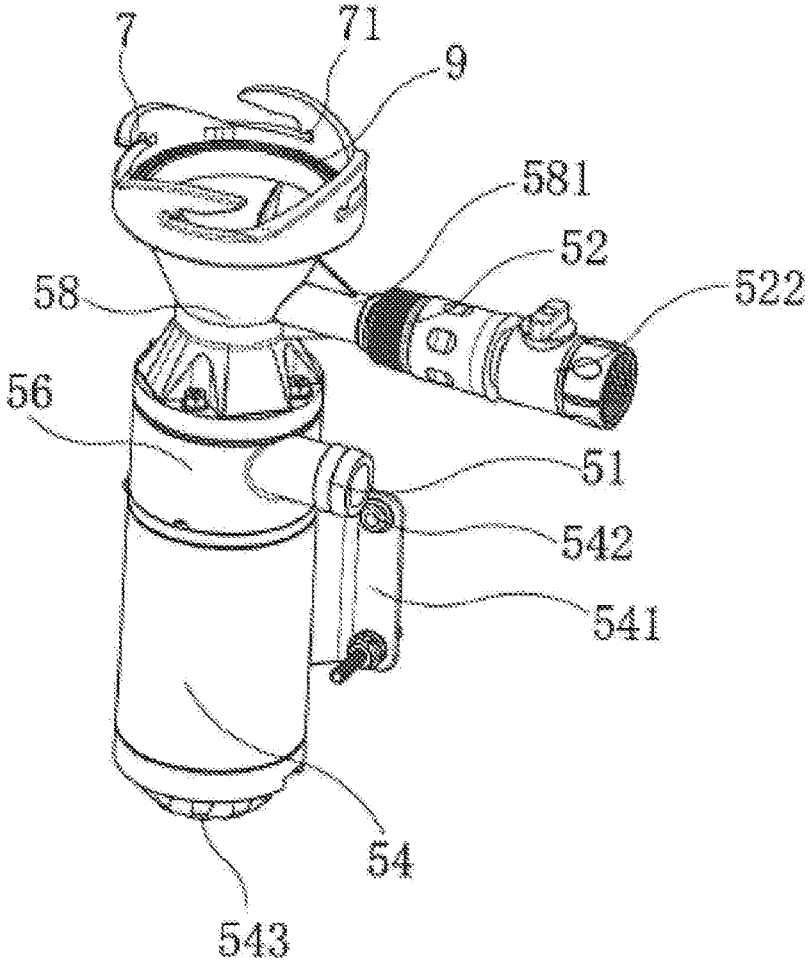

1, sewage tank; 11, connecting pipe;

2, drain pipe; 21, first coupling assembly; 211, first threaded coupling; 212, first coupling; 22, second coupling assembly; 221, second threaded coupling; 222, second coupling; 021, snap ring; 022, end concave portion; 023, stop block;

3, main box body; 31, master switch; 32, lifting handle; 33, bottom housing; 34, upper cover;

4, drain control valve; 41, primary pipe; 42, first main coupling; 43, fixing ring; 44, secondary pipe; 45, handle; 46, valve disc;

5, self-priming drain pump; 51, drain nozzle; 52, cleaning coupling; 53, one-way valve; 521, annular sealing member; 522, quick connector; 5221, clamping block; 54, motor; 55, impeller; 56, pump body; 541, motor bracket; 542, anti-vibration pad; 543, anti jamming manual rotary knob; 57, crushing blade; 58, pump connector; 581, cleaning water inlet; 582, sawtooth structure;

6, sewage pipe; 61, drain connector; 611, grip; 612, pipe connection end; 613, control switch; 614, electrically conductive wire; 615, threaded section;

7, clamping claw; 71, elastic buffer port;

8, clamping column;

9, sealing ring; and

01, sewage outlet.

DETAILED DESCRIPTION OF THE EMBODIMENTS

In order to achieve the above-mentioned objectives and technical effects, the characteristics and functions of the technical means and structures adopted by the present invention are illustrated in detail below with reference to the preferred embodiments of the present invention to facilitate a complete understanding.

Referring to FIGS. 1-14, the present invention provides a sewage discharge device detachably and hermetically connected to the sewage tank 1, which includes the drain pipe 2 and the main box body 3. The drain control valve 4 and the self-priming drain pump 5 are provided inside the main box body 3. One end of the drain control valve 4 is detachably and hermetically connected to the drain pipe 2, and the other end of the drain control valve 4 is detachably and hermetically connected to the self-priming drain pump 5. The self-priming drain pump 5 is provided with the drain nozzle 51 and the cleaning coupling 52. The drain nozzle 51 is detachably and hermetically connected to the sewage pipe 6. One end of each of the drain nozzle 51, the cleaning coupling 52 and the drain control valve 4 protrudes out of the main box body 3.

Thus, the drain control valve 4 and the self-priming drain pump 5 are provided inside the main box body 3 according to the structural design of the drain pipe 2 and the main box body 3. Sewage in the drain pipe 2 is controlled to enter the self-priming drain pump 5 by the drain control valve 4 and then discharged through the drain nozzle 51 and sewage pipe 6 of the self-priming drain pump 5 after being treated by the self-priming drain pump 5. When the domestic sewage has been discharged, the cleaning coupling 52 arranged on the self-priming drain pump 5 is configured to introduce cleaning water to clean the drain pipe 2 and the self-priming drain pump 5. Then the cleaning water is discharged through the drain nozzle 51 of the self-priming drain pump 5 and the sewage pipe 6. In this way, it is convenient to use the sewage discharge device without the need to manually clean the drain pipe 2, which prevents users from contacting sewage. Moreover, since the drain control valve 4 and the self-priming drain pump 5 are both provided inside the main box body 3, it is convenient for users to carry the sewage discharge device.

Furthermore, the master switch 31 for controlling the operation of the self-priming drain pump 5 is provided on a side wall of the main box body 3. The master switch 31, the drain nozzle 51 and the cleaning coupling 52 are located on the same side of the main box body 3 to facilitate unified control. The master switch 31 is connected to the self-priming drain pump 5 via a wire.

Figure 12:
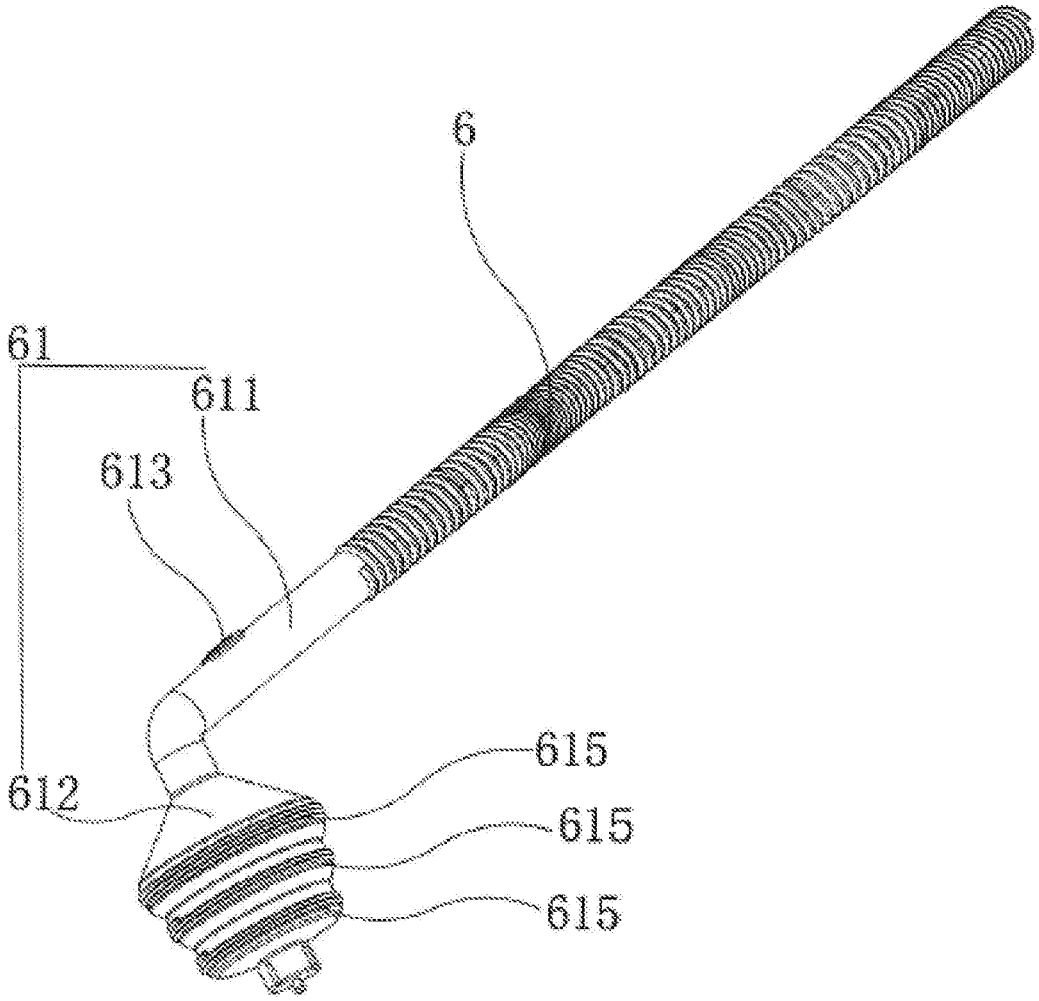
FIG. 12 is a perspective view of the sewage pipe of the present invention.
Figure 13:
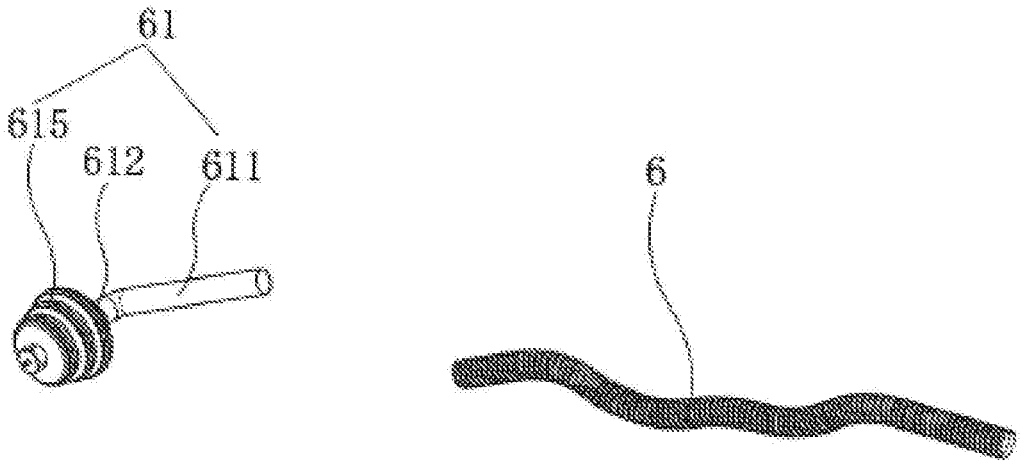
FIG. 13 is an exploded view of the sewage pipe of the present invention.
Figure 14:
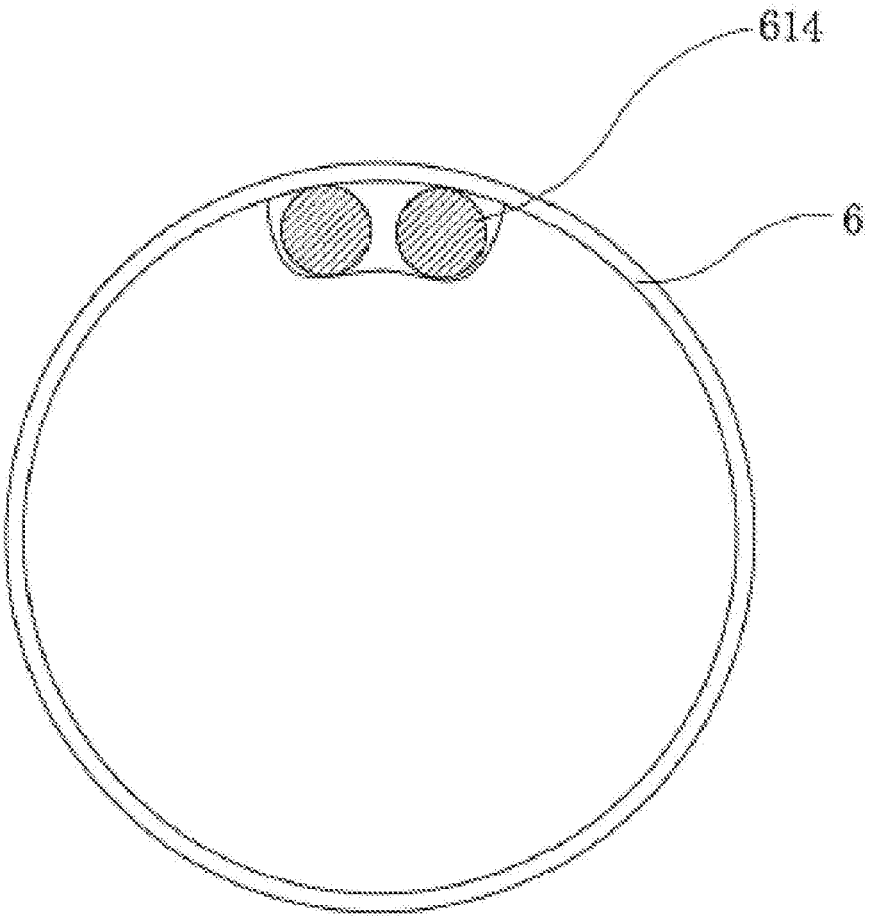
FIG. 14 is a cross-sectional view of the sewage pipe of the present invention when the control switch is connected to the self-priming drain pump in a wired manner.

Further, referring to FIGS. 12-14, the sewage pipe 6 is provided with the drain connector 61. One end of the drain connector 61 is the grip 611. The other end of the drain connector 61 is the pipe connection end 612. The grip 611 is provided with the control switch 613 for controlling the operation of the self-priming drain pump 5. In this arrangement, in use, it is convenient for users to control the operation of the self-priming drain pump 5 by operating the control switch 613 located on the grip 611 without the need of operating the master switch 31 on the main cabinet 3, which improves the convenience of the present invention in use.

In addition, the control switch 613 is connected to the self-priming drain pump 5 in a wired or wireless manner so that the users can operate the control switch 613 to control the self-priming drain pump 5.

When the control switch 613 is connected to the self-priming drain pump 5 in a wired manner, the electrically conductive wire 614 is embedded in the sewage pipe 6 in advance. As shown in FIG. 14, the control switch 613 is a common mechanical switch. When the control switch 613 is connected to the self-priming drain pump 5 in a wireless manner, the control switch 613 is the wireless control switch 613 capable of receiving high-frequency analog signals.

Further, the pipe connection end 612 is provided with a multilayer threaded section 615. The diameter of the threaded section 615 successively increases from bottom to top, so that the pipe connection end 612 can fit the sewage outlets 01 with different diameters at various sewage treatment stations. In the present embodiment, the multilayer threaded section 615 has three layers, but not limited thereto. The number of the layers of the multilayer threaded section 615 can be two or more than three.

Figure 10:
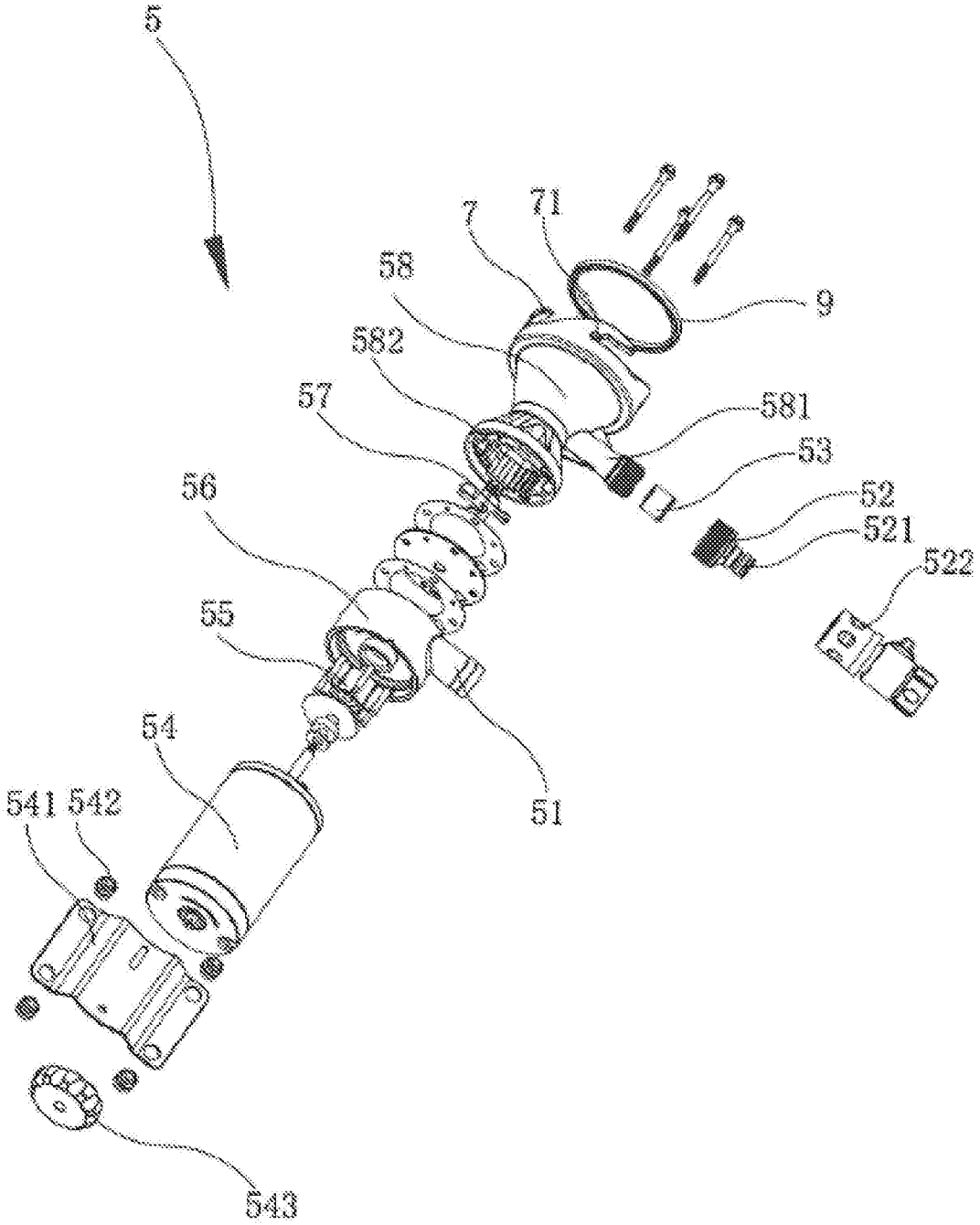
FIG. 10 is an exploded view of the self-priming drain pump of the present invention.
Figure 11:
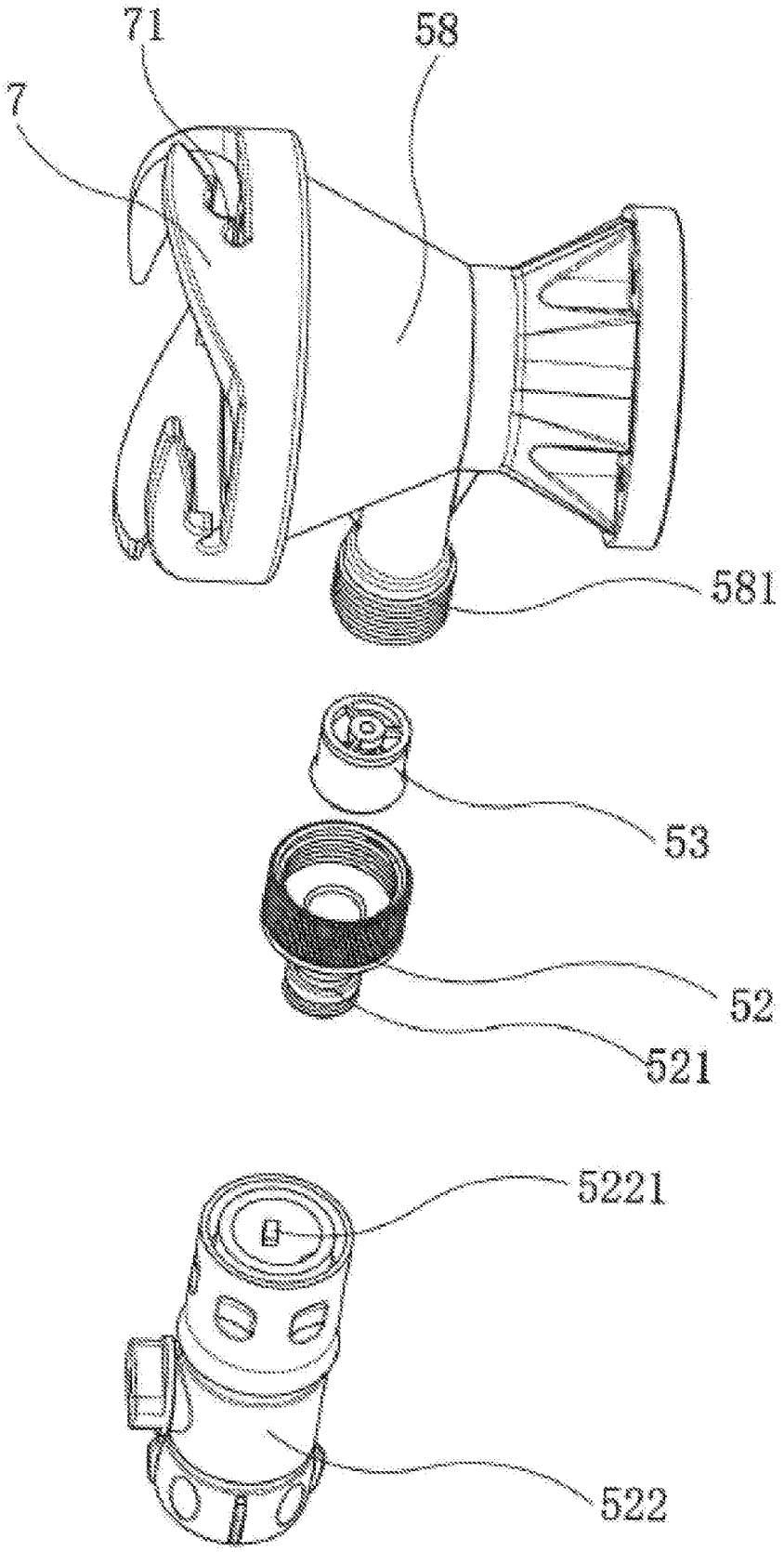
FIG. 11 is a partially exploded view of the self-priming drain pump of the present invention.

Referring to FIG. 10, the self-priming drain pump 5 includes the motor 54, the impeller 55, the pump body 56, the crushing blade 57 and the pump connector 58. The rotating shaft of the motor 54 drives the impeller 55 to rotate. The drain nozzle 51 is arranged on the pump body 56. The crushing blade 57 is rotatably arranged at one end of the pump body 56, and the other end of the pump body 56 is detachably fixed to the motor 54. One end of the pump connector 58 is detachably fixed to one end of the pump body 56, and the other end of the pump connector 58 is hermetically connected to the other end of the drain control valve 4. The cleaning water inlet 581 is arranged in the middle of the pump connector 58 and protrudes from the middle of the pump connector 58. The cleaning coupling 52 is hermetically connected to the outside of the cleaning water inlet 581. The one-way valve 53 is provided inside the cleaning coupling 52. The one-way valve 53 is provided between the cleaning water inlet 581 and the cleaning coupling 52. In this arrangement, large impurities in the sewage can be crushed and then easily discharged along with the sewage through the drain nozzle 51.

The cleaning coupling 52 is hermetically connected to the cleaning water inlet 581 by means of a threaded connection, but not limited thereto. The cleaning coupling 52 may also be hermetically connected to the cleaning water inlet 581 by other structures. The sawtooth structures 582 are arranged at intervals on the inner wall of one end of the pump connector 58 to increase resistance and facilitate crushing the impurities.

Further, the motor bracket 541 is detachably fixed under the motor 54. The anti-vibration pad 542 is fixed at the end of the motor bracket 541 to prevent resonance.

Further, the motor 54 is provided with the anti jamming manual rotary knob 543. The anti jamming manual rotary knob 543 protrudes outside the main box body 3, so that the rotating shaft of the motor 54 is rotated by operating the anti jamming manual rotary knob 543, which effectively prevents the crushing blade 57 from being jammed.

Further, in order to facilitate the assembly of the sewage discharge device of the present invention, the other end of the pump connector 58 and the other end of the drain control valve 4 are connected by the clamping claw 7 and the clamping column 8 to form a quick-disconnect fitting. The drain pipe 2 and the sewage tank 1 are connected through the clamping claw 7 and the clamping column 8 snap-fitted with each other to form a quick-disconnect fitting. One end of the drain control valve 4 is connected to the drain pipe 2 through the clamping claw 7 and the clamping column 8 snap-fitted with each other to form a quick-disconnect fitting.

The sewage pipe 6 and the drain pipe 2 may both be threaded pipes.

Referring to FIGS. 3-11, for example, one end of the drain control valve 4 is provided with the primary pipe 41. The side wall of the main pipe 41 is provided with the rotatable first main coupling 42. The first main coupling 42 is provided with a plurality of clamping claws 7, wherein the plurality of clamping claws 7 are arranged at intervals and protrude from the first main coupling 42. The fixing ring 43 is fixed in the primary pipe 41, and the fixing ring 43 restricts the first main coupling 42 to the primary pipe 41. The sealing ring 9 is fixed between the fixed ring 43 and the inner wall of the first main coupling 42.

The first coupling assembly 21 is detachably arranged at one end of the drain pipe 2. The first coupling assembly 21 includes the first threaded coupling 211 and the first coupling 212. The snap ring 021 is provided on the inner wall of the first coupling 212 and protrudes from the inner wall of the first coupling 212. The snap ring 021 of the first coupling 212 is rotatably engaged into the end concave portion 022 of the first threaded coupling 211. A plurality of clamping columns 8 are arranged at intervals on the outer wall of the first coupling 212. The clamping claws 7 of the first main coupling 42 are respectively clamped into the corresponding clamping columns 8 of the first coupling 212. The stop block 023 is provided below each of the clamping columns 8 of the first coupling 212. The clamping claw 7 of the first main coupling 42 is located between the clamping column 8 of the first coupling 212 and the stop block 023. In this way, the clamping claw 7 of the first main coupling 42 is prevented from coming apart so that users can hold the stop block 023 of the first coupling 212 to rotate the first coupling 212. The sealing ring 9 is provided inside the first coupling 212. The second coupling assembly 22 is detachably arranged at the other end of the drain pipe 2. The second coupling assembly 22 includes the second threaded coupling 221 and the second coupling 222. The snap ring 021 is provided on the inner wall of the second coupling 222 and protrudes from the inner wall of the second coupling 222. The snap ring 021 of the second coupling 222 is rotatably engaged into the end concave portion 022 of the second threaded coupling 221. A plurality of clamping claws 7 are provided at the end of the second coupling 222 away from the drain pipe 2 and protrude from the end of the second coupling 222. A plurality of stop blocks 023 are arranged at intervals on the side wall of the second coupling 222 and protrude from the side wall of the second coupling 222, which is convenient for users to hold the stop blocks 023 of the second coupling 222 to rotate the second coupling 222. The sealing ring 9 is provided inside the second coupling 222. The first threaded coupling 211 and the second threaded coupling 221 are connected to the drain pipe 2 by threads. Since the first coupling 212 and the second coupling 222 are integrally formed, it is convenient for users to force the first coupling 212 to rotate relative to the first threaded coupling 211 and force the second coupling 222 to rotate relative to the second threaded coupling 221. The first coupling 212, the second coupling 222, the first threaded coupling 211, and the second threaded coupling 221 is made of plastic material and thus are easy to manufacture.

The connecting pipe 11 is fixedly arranged on the sewage outlet of the sewage tank 1. A plurality of clamping columns 8 are arranged at intervals on the side wall of the connecting pipe 11 and protrude from the side wall of the connecting pipe 11. The clamping claws 7 of the second coupling 222 are respectively clamped into the corresponding clamping columns 8 of the connecting pipe 11.

The elastic buffer port 71 is recessed into the inner end of the clamping claw 7 of the second coupling 222 to improve the elasticity of the clamping claw 7 of the second coupling 222 and prevent the clamping claws 7 of the second coupling 222 against damage. In this way, the clamping claws 7 of the second coupling 222 can be quickly and effortlessly clamped into the corresponding clamping columns 8 of the connecting pipe 11.

The other end of the drain control valve 4 is provided with the secondary pipe 44. A plurality of clamping columns 8 are arranged at intervals on the outer wall of the secondary pipe 44. A plurality of clamping claws 7 are arranged at intervals at the other end of the pump connector 58. The clamping claws 7 of the pump connector 58 are respectively clamped into the corresponding clamping columns 8 of the secondary pipe 44. The elastic buffer port 71 is recessed into the inner end of the clamping claw 7 of the pump connector 58 to improve the elasticity of the clamping claw 7 of the pump connector 58 and to prevent damage to the clamping claws 7 of the pump connector 58. In this way, the clamping claws 7 of the pump connector 58 can be quickly and effortlessly clamped into the corresponding clamping columns 8 of the secondary pipe 44.

Therefore, in the present invention, it is convenient to install and connect the pump connector 58 and the drain control valve 4, install and connect the drain pipe 2 and the sewage tank 1 as well as install and connect the drain control valve 4 and the drain pipe 2 and the production cost is lowered. The number of the clamping columns 8 is equal to the number of the clamping claws 7. The number of the clamping columns 8 or clamping claws 7 is four, but not limited thereto.

Further, the lifting handle 32 is provided on the main box body 3 to facilitate carrying the sewage discharge device. The lifting handle 32 and the main box body 3 are integrally formed into a single unit. Alternatively, the lifting handle 32 can also be fastened to the main box body 3 by screws.

The main box body 3 includes the bottom housing 33 and the upper cover 34. The upper cover 34 is fastened to the bottom housing 33 by screws. The self-priming drain pump 5 and the drain control valve 4 are provided in the bottom housing 33. The drain control valve 4 is provided with the handle 45. The user can pull or push the handle 45 to control the drain control valve 4 to open or close the valve disc 46, so as to connect the drain pipe 2 to the self-priming drain pump 5 or disconnect the drain pipe 2 from the self-priming drain pump 5, which is convenient for users to operate and control the drain control valve 4.

Further, a plurality of annular sealing members 521 are arranged at intervals on the end side wall of the cleaning coupling 52 to quickly assemble the cleaning coupling 52 and the quick connector 522. The end of the cleaning coupling 52 is hermetically connected to the quick connector 522. The quick connector 522 is hermetically connected to a faucet through a water pipe. Two clamping blocks 5221 are arranged on the inner wall of the quick connector 522 and protrude from the inner wall of the quick connector 522. The clamping blocks 5221 are tightly clamped between the annular sealing members 521, so that the quick connector 522 is detachably and tightly connected to the end of the cleaning coupling 52.

The technical content and technical features of the present invention have been disclosed as above, and the number of components of the present invention is not limited thereto. Those skilled in the art can still make various replacements and modifications based on the disclosure of the present invention without departing from the creative spirit of the present invention. Therefore, the scope of protection of the present invention should not be limited to those disclosed in the embodiments, but should include various replacements and modifications made without deviating from the present invention, and these replacements and modifications are covered by the claims.

What is claimed is:

1. A sewage discharge device, comprising
a drain pipe, and
a main box body;
wherein
the sewage discharge device is detachably and hermetically connected to a sewage tank;
a drain control valve and a self-priming drain pump are provided inside the main box body;
a first end of the drain control valve is detachably and hermetically connected to the drain pipe, and a second end of the drain control valve is detachably and hermetically connected to the self-priming drain pump;
the self-priming drain pump is provided with a drain nozzle and a cleaning coupling;
the drain nozzle is detachably and hermetically connected to a sewage pipe;
the drain nozzle and the cleaning coupling protrude outside the main box body;
the sewage pipe is provided with a drain connector;
a first end of the drain connector is a grip, and a second end of the drain connector is a pipe connection end; and
a control switch is provided on the grip and configured to control operation of the self-priming drain pump.

2. The sewage discharge device according to claim 1, wherein,
a master switch is provided on a side wall of the main box body and configured to control operation of the self-priming drain pump; and the master switch, the drain nozzle and the cleaning coupling are located on one side of the main box body.

3. The sewage discharge device according to claim 1, wherein,
the control switch is connected to the self-priming drain pump in a wired manner or a wireless manner.

4. The sewage discharge device according to claim 1, wherein,
the pipe connection end is provided with a multilayer threaded section, and a diameter of the multilayer threaded section successively increases from bottom to top.

5. The sewage discharge device according to claim 1, wherein
a lifting handle is provided on the main box body.

6. A sewage discharge device, comprising
a drain pipe, and
a main box body;
wherein
the sewage discharge device is detachably and hermetically connected to a sewage tank;
a drain control valve and a self-priming drain pump are provided inside the main box body;
a first end of the drain control valve is detachably and hermetically connected to the drain pipe, and a second end of the drain control valve is detachably and hermetically connected to the self-priming drain pump;
the self-priming drain pump is provided with a drain nozzle and a cleaning coupling;
the drain nozzle is detachably and hermetically connected to a sewage pipe;
the drain nozzle and the cleaning coupling protrude outside the main box body;

the self-priming drain pump comprises a motor, an impeller, a pump body, a crushing blade and a pump connector;

a rotating shaft of the motor drives the impeller to rotate; the drain nozzle is arranged on the pump body;

the crushing blade is rotatably arranged at a first end of the pump body, and a second end of the pump body is detachably fixed to the motor;

a first end of the pump connector is detachably fixed to the first end of the pump body, and a second end of the pump connector is hermetically connected to the second end of the drain control valve;

a cleaning water inlet is arranged at a middle of the pump connector and protrudes from the middle of the pump connector;

the cleaning coupling is hermetically connected to an outside of the cleaning water inlet; and a one-way valve is provided inside the cleaning coupling, and the one-way valve is provided between the cleaning water inlet and the cleaning coupling.

7. The sewage discharge device according to claim 6, wherein, a motor bracket is detachably fixed under the motor, and an end of the motor bracket is fixed to an anti-vibration pad.

8. The sewage discharge device according to claim 6, wherein, the motor is provided with an anti jamming manual rotary knob, and the anti jamming manual rotary knob is arranged outside the main box body and protrudes from the main box body.

9. The sewage discharge device according to claim 6, wherein, the second end of the pump connector and the second end of the drain control valve are connected through a first clamping claw and a first clamping column snap-fitted with each other to form a quick-disconnect fitting between the pump connector and the drain control valve;

the drain pipe and the sewage tank are connected through a second clamping claw and a second clamping column snap-fitted with each other to form a quick-disconnect fitting between the drain pipe and the sewage tank; and the first end of the drain control valve is connected to the drain pipe through a third clamping claw and a third clamping column snap-fitted with each other to form a quick-disconnect fitting between the drain control valve and the drain pipe.

* * * * *